US005250398A

United States Patent [19]

Begley et al.

[11] Patent Number: 5,250,398

[45] **Date of Patent: * Oct. 5, 1993**

[54] PHOTOGRAPHIC SILVER HALIDE MATERIAL AND PROCESS COMPRISING WATER-SOLUBILIZED NAPHTHOLIC COUPLER

[75] Inventors: William J. Begley, Webster; Teh-hsuan Chen, Fairport, both of N.Y.

[73] Assignee: Eastman Kodak Company, Rochester, N.Y.

[ * ] Notice: The portion of the term of this patent subsequent to Sep. 29, 2009 has been disclaimed.

[21] Appl. No.: 722,808

[22] Filed: Jun. 28, 1991

[51] Int. Cl.[5] ..... G03C 7/34

[52] U.S. Cl. ..... 430/382; 430/385; 430/226; 430/544; 430/512; 430/548; 430/549; 430/553; 430/955; 430/957

[58] Field of Search ..... 430/226, 544, 543, 553, 430/957, 955, 548, 512, 382, 376, 385, 549

[56] References Cited

U.S. PATENT DOCUMENTS

| | | | |
|---|---|---|---|
| 4,248,962 | 2/1981 | Lau | 430/282 |
| 4,409,323 | 10/1983 | Sato et al. | 430/544 |
| 4,482,629 | 11/1984 | Nakagawa et al. | 430/542 |
| 4,528,263 | 7/1985 | Sugita et al. | 430/544 |
| 4,652,515 | 3/1987 | Ogawa et al. | 430/505 |
| 4,746,600 | 5/1988 | Watanabe et al. | 430/505 |
| 4,749,644 | 6/1988 | Tosaka et al. | 430/544 |
| 4,798,784 | 1/1989 | Kishimoto et al. | 430/382 |
| 4,853,319 | 8/1989 | Krishnamurthy et al. | 430/387 |
| 4,861,701 | 8/1989 | Burns et al. | 430/543 |
| 5,026,628 | 6/1981 | Begley et al. | 430/382 |
| 5,151,343 | 9/1992 | Begley et al. | 430/544 |

OTHER PUBLICATIONS

*Research Disclosure*, Dec. 1989, Item No. 308119 Kenneth Mason Publications, Emsworth, Hampshire P010 7DQ, England.

*Primary Examiner*—Richard L. Schilling
*Attorney, Agent, or Firm*—Peter C. Cody

[57] ABSTRACT

A photographic silver halide material and process comprises at least one image dye-forming coupler and at least one coupler (A) represented by the formula SOL-COUP-LINK-PUG wherein SOL is a water solubilizing amide group, COUP is a naphtholic coupler moiety that, upon reaction with oxidized developer is capable of releasing LINK-PUG and capable of forming a compound that is washed out of the photographic material during photographic processing; LINK-PUG is in turn capable of releasing a photographically useful group (PUG) during photographic processing; and wherein LINK is a carbamate linking group comprising a photographic ballast group on the nitrogen atom of the carbamate group. Such a photographic silver halide material enables formation of improved images.

7 Claims, No Drawings

PHOTOGRAPHIC SILVER HALIDE MATERIAL AND PROCESS COMPRISING WATER-SOLUBILIZED NAPHTHOLIC COUPLER

This invention relates to a new photographic compound that is capable of forming a wash-out dye in a photographic material upon photographic processing to form an improved image and to a photographic material and process using such a compound.

Various ways are recognized in the photographic art for release of a photographically useful group (PUG) from a compound, such as a coupler, in a photographic material and process. For example, U.S. Pat. No. 4,248,962 describes compounds that release photographically useful groups by means of an intramolecular nucleophilic displacement reaction in photographic materials. Other examples of means for release of photographically useful groups are described in, for example, U.S. Pat. Nos. 4,409,323 and 4,861,701. These compounds, particularly couplers, capable of releasing a photographically useful group provide a degree of control over timing and rate of release as well as rate of diffusion and distance of diffusion of the photographically useful group.

The part of the compound that remains in the photographic material after release of the photographically useful group and the dye that is formed in the material from reaction with oxidized color developer often provides undesired properties in the photographic material during or after photographic processing. For example the dye formed from a coupler upon release of a photographically useful group often adversely affects the desired image. One answer to this has been to provide a coupler that has a water solubilizing group on the parent coupler to enable the dye formed from the coupler to washed-out of the photographic element upon photographic processing. Such couplers are described, for example in U.S. Pat. No. 4,482,629.

A need has existed to provide a compound, particularly a coupler, in a photographic material and process that enables formation of an improved image while enabling removal by wash-out of the dye formed from the compound, particularly the dye formed from the coupler during photographic processing. Moreover, such needs have existed with the added parameter that such a compound must not require significantly modifying the photographically useful groups in a way that would adversely affect the ultimate end use of the groups.

The present invention solves these problems by means of a photographic element comprising a support bearing at least one photographic silver halide emulsion layer and at least one coupler (A) represented by the formula SOL-COUP-LINK-PUG wherein SOL is a water solubilizing amide group, COUP is a naphtholic coupler moiety that, upon reaction with oxidized color developing agent, is capable of releasing LINK-PUG and capable of forming a compound that is washed out of the photographic element during photographic processing; wherein LINK-PUG is in turn capable of releasing a photographically useful group (PUG) during photographic processing; and LINK is a carbamate linking group comprising a photographic ballast group on the nitrogen atom of the carbamate group. The ballast group location on the nitrogen atom of the carbamate group enables a photographic silver halide material comprising this described coupler to provide an image having improved effects.

The described carbamate group is typically represented by the formula:

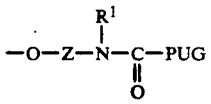

wherein —O— is bonded to the coupling position of the naphtholic coupler; Z represents the atoms completing the carbamate group, such as

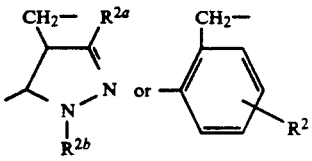

wherein the $CH_2$— is bonded to the

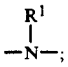

$R^1$ is a photographic ballast group; PUG is a photographically useful group, preferably INH which is a photographic development inhibitor group; and $R^2$, $R^{2a}$ and $R^{2b}$ are individually hydrogen or a substituent that does not adversely affect the coupler or photographic material in which the coupler is used, $R^{2a}$ and $R^{2b}$ are typically substituted or unsubstituted alkyl or aryl. R2 is, for example, $NO_2$ alkyl, sulfonamido or sulfamyl.

The naphtholic coupler moiety can be any naphtholic coupler moiety that, upon reaction with oxidized color developing agent enables release of the coupling-off group, and is capable of forming a compound that is washed-out of the photographic processing. Such naphtholic couplers are described in, for example, U.S. Pat. No. 5,026,628 and U.S. Pat. No. 4,482,629.

A preferred naphtholic coupler as described is represented by the formula:

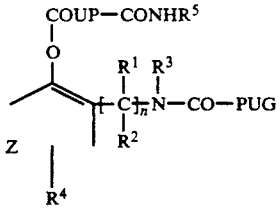

wherein n is 0 or 1

$R^1$ and $R^2$ individually are hydrogen, alkyl or aryl;

$R^3$ is photographic ballast group;

$R^4$ is hydrogen or a substituent;

$R^5$ is hydrogen, $CH_3$, $C_2H_5$, $CH_2CO_2R_6$ or phenyl-SOL wherein SOL is a water solubilizing group;

$R^6$ is hydrogen or alkyl;

PUG is a photographically useful group;

COUP is a naphtholic coupler; and,

Z represents the atoms completing a 5 or 6 member aromatic or heterocyclic group.

A process of forming an image having the described advantages comprises developing an exposed photographic element by means of a color developing agent in the presence of described coupler (A).

The water solubilizing group (SOL) on the coupler (A) can be any water solubilizing group known in the photographic art to enable wash-out of the dye formed in photographic processing from the coupler (A). Typical water-solubilizing groups include groups terminated with an acid group, such as carboxy, sulfo or hydroxy which may also form a salt and other groups described in U.S. Pat. No. 4,482,629 (col. 4, lines 1–3) and amide groups, such as described in U.S. Pat. No. 5,026,628. The coupler (A) can have one or more water-solubilizing groups. The number and type of water solubilizing groups should not be sufficient to make the coupler (A) mobile in the photographic element prior to exposure and processing. The coupling-off group can also contain one or more water-solubilizing groups if desired.

A typical water-solbbilizing group SOL is a carbonamido group —$CONHR_a$ wherein $R_a$ can be an alkyl group containing 1 to 3 carbon atoms, but preferably —$CONH_2$, —$CONHCH_3$ or —$CONHC_2H_5$; or a group containing a water-solubilizing group, such as carboxy, sulfo or hydroxy groups, for instance, —$CONH_2CH_2CH_2OH$, —$CONH_2CH_2CO_2H$, or —$CONH_2CH_2CH_2CO_2H$. Such a group can be, for example, in the 2-position of a naphtholic coupler.

During photographic processing, the reaction of coupler (A), preferably a coupler, with oxidized color developing agent cleaves the bond between the coupling-off group and the coupler portion of the coupler (A). Then the bond between the carbamate group and the PUG is cleaved. Tailoring of the particular parts of the carbamate group to requirements of the given PUG allows control over the timing and rate of release of the PUG. wherein SOL is a water-solubilizing group, as described, preferably —COOH or —$CONHCH_3$;

COUP is a dye-forming coupler, preferably a cyan dye-forming coupler, having the remainder of the molecule substituted in the coupling position;

Z represents the atoms necessary to complete an unsubstituted or substituted arylene, preferably phenylene, or heterocyclic group;

$R_1$ and $R_2$ individually represent hydrogen or alkyl, such alkyl containing 1 to 40 carbon atoms;

$R_3$ is a divalent group that enables formation of a ring, particularly a 5-, 6- or 7-member ring, upon processing the photographic element;

$R_4$ is hydrogen or a substituent that does not adversely affect the coupler or photographic material in which the coupler is used, such as unsubstituted or substituted alkyl, unsubstituted or substituted aryl, Y $R_5$ is the same as $R_a$, as defined above nitro, sulfonamido, sulfamyl, and carbon-amido.

PUG is a releasable photographically useful group, preferably a releasable development inhibitor group. When the PUG is a releasable development inhibitor group preferably a benzotriazole development inhibitor group, improved image effects are observed in a photographic element of the invention As used herein the term photographic ballast group (BALL) is a ballast group that is known in the photographic art. The ballast group as described is an organic group of such size and configuration as to confer on the molecule sufficient bulk to render the molecule substantially non-diffusible from the layer in which it is coated in a photographic element. Representative ballast groups include substituted or unsubstituted alkyl or aryl groups typically containing 8 to 40 carbon atoms.

As used herein the terms "coupler" and "coupler compound" refer to the entire compound, including the coupler moiety and the coupling-off group including the PUG. The term "coupler moiety" refers to that portion of the compound other than the coupling-off group.

The PUG can be any group that is typically made available in a photographic element in an imagewise fashion. The PUG can be a photographic reagent or a photographic dye. A photographic reagent herein is a moiety that upon release further reacts with components in the photographic element, such as a development inhibitor, a development accelerator, a bleach inhibitor, a bleach accelerator, a coupler (for example, a competing coupler, a dye-forming coupler, or a development inhibitor releasing coupler (DIR coupler)), a dye precursor, a dye, a developing agent (for example, a competing developing agent, a dye-forming developing agent, or a silver halide developing agent), a silver complexing agent, a fixing agent, an image toner, a stabilizer, a hardener, a tanning agent, a fogging agent, an ultraviolet radiation absorber, an antifoggant, a nucleator, a chemical or spectral sensitizer or a desensitizer. The PUG is preferably a releasable development inhibitor group.

The PUG can be present in the coupling-off group as a preformed species or it can be present in a blocked form or as a precursor. The PUG can be for example a preformed development inhibitor or the development inhibiting function can be blocked by being the point of attachment to the carbonyl group bonded to PUG in the coupling-off group. Other examples are a preformed dye. a dye that is blocked to shift its absorption, and a leuco dye.

The described naphtholic coupler can be used in combination with any photographic couplers known in the photographic art. There follows a listing of patents and publications that describe representative couplers useful in photographic silver halide materials of the invention:

A. Couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; 4,333,999 and "Farbkuppler-eine Literaturubersicht," published in Agfa Mitteilungen, Band III, pp. 156–175 (1961).

Preferably such couplers are phenols and naphthols which form cyan dyes on reaction with oxidized color developing agent.

B. Couplers which form magenta dyes upon reaction with oxidized color developing agent are publications as: U.S. Pat. Nos. 2,600,788; 2,369,489; 2,343,703; 2,311,082; 3,152,896; 3,519,429; 3,062,653; 2,908,573 and "Farbkuppler-eine Mitteilungen, Band III, pp. 126–156 (1961).

Preferably such magenta dye-forming couplers are pyrazolones or pyrazolotriazole couplers.

C. Couplers which form yellow dyes upon reaction with oxidized and color developing agent are described in such representative patents and publications as: U.S.

Pat. Nos. 2,875,057; 2,407,210; 3,265,506; 2,298,443; 3,048,194; 3,447,928 and "Farbkuppler-eine Mitteilungen, Band III, pp. 112–126 (1961).

Preferably such yellow dye-forming couplers are acylacetamides, such as benzoylacetamides and pivaloylacetamides.

D. Couplers which form colorless products upon reaction with oxidized color developing agent are described in such representative patents as: U.K. Patent No. 861,138; U.S. Pat. Nos. 3,632,345; 3,928,041; 3,958,993 and 3,961,959.

PUG groups that are useful include, for example:

PUG's

A. PUG's which form development inhibitors upon release are described in such representative patents as U.S. Pat. Nos. 3,227,554; 3,384,657; 3,615,506; 3,617,291; 3,733,201 and U.K. Patent No. 1,450,479. Preferred development inhibitors are iodide and geterocyclic compounds such as mercaptotetrazoles, selenotetrazoles, mercaptobenzothiazoles, selenobenzothiazoles, mercaptobenzoxazoles, selsnobenzimidazoles, oxadiazoles, benzotriazoles and benzodiazoles, such as described in U.S. Pat. 5,026,628.

B. PUG's which are, or form, dyes upon release:

Suitable dyes and dye precursors include azo, azomethine, azopyrazolone, indoaniline, indophenol, anthraquinone, triarylmethane, alizarin, nitro, quinoline, indigoid and phthalocyanine dyes or precursors of such dyes such as leuco dyes, tetrazolium salts or shifted dyes. These dyes can be metal complexed or metal complexable. Representative patents describing such dyes are U.S. Pat. Nos. 3,880,658; 3,931,144; 3,932,380; 3,932,381 and 3,942,987. Preferred dyes and dye precursors are azo, azomethine and indoaniline dyes and dye precursors. Structures of some preferred dyes are described in U.S. Pat. 5,026,628.

C. PUG's which are couplers:

Couplers released can be nondiffusible colorforming couplers, non-color forming couplers or diffusible competing couplers. Representative patents and publications describing competing couplers are: "On the Chemistry of White Couplers," by W. Pushcel, AgfaGevaert AG Mitteilungen and der Forschungs-Laboratorium der Agfa-Gevaert AG, Springer Verlag, 1954, pp. 352–367; U.S. Pat. Nos. 2,998,314; 2,808,329; 2,689,793; 2,742,832; German Patent No. 1,168,769 and British Patent No. 907,274.

D. PUG's which form developing agents:

Developing agents released can be color developing agents, black-and-white developing agents or cross-oxidizing developing agents. They include aminophenols, phenylene diamines, hydroquinones and pyrazolidones. Representative patents are: U.S. Pat. Nos. 2,193,015; 2,108,243; 2,592,364; 3,656,950; 3,658,525; 2,751,297; 2,289,367; 2,772,282; 2,743,279; 2,753,256 and 2,304,953.

E. PUG's which are bleach inhibitors: Representative patents are U.S. Pat. Nos. 3,705,801; 3,715,208; and German OLS No. 2,405,279. Structures of preferred bleach inhibitors are:

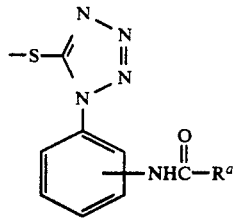
IIIE-1

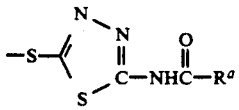
IIIE-2

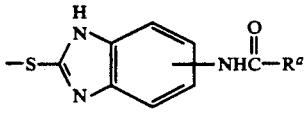
IIIE-3

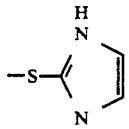
IIIE-4 where $R^a$ is alkyl such as lalkyl of 6 to 20 carbon atoms.

F. PUG's which are bleach accelerators:

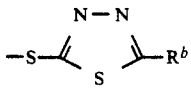
IIIF-1

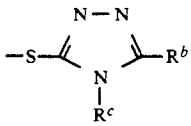
IIIF-2

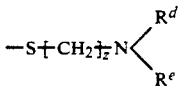
IIIF-3

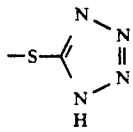
IIIF-4

$-SCH_2CH_2COOH$ IIIF-5 wherein $R^b$ is hydrogen, alkyl, such as ethyl and butyl, alkoxy, such as ethoxy and butoxy, or alkylthio, such as ethylthio and butylthio, for example containing 1 to 6 carbon atoms, and which may be unsubstituted or substituted; $R^c$ is hydrogen, alkyl or aryl, such as phenyl; $R^d$ and $R^e$ are individually alkyl, such as alkyl containing 1 to 6 carbon atoms, for example ethyl and butyl; z is 1 to 6.

The photographic couplers of the invention can be incorporated in photographic elements by means and processes known in the photographic art. In a photographic element prior to exposure and processing the photographic coupler should be of such size and configuration that it will not diffuse through the photographic layers.

Photographic elements of this invention can be processed by conventional techniques in which color forming couplers and color developing agents are incorporated in separate processing solutions or compositions or in the element Photographic elements in which the compounds of this invention are incorporated can be a simple element comprising a support and a single silver halide emulsion layer or they can be multilayer, multicolor elements. The compounds of this invention can be incorporated in at least one of the silver halide emulsion layers and/or in at least one other layer, such as an adjacent layer, where they will come into reactive association with oxidized color developing agent which has developed silver halide in the emulsion layer The silver halide emulsion layer can contain or have associated with it, other photographic coupler compounds, such as dye-. couplers, colored masking couplers, and/or competing couplers. These other photographic couplers can form dyes of the same or different color and hue as the photographic couplers of this invention. Additionally, the silver halide emulsion layers and other layers of the photographic element can contain addenda conventionally contained in such layers.

A typical multilayer, multicolor photographic element can comprise a support having thereon a redsensitive silver halide emulsion unit having associated therewith a cyan dye image-providing material, a greensensitive silver halide emulsion unit having associated therewith a magenta dye image-providing material and a blue-sensitive silver halide emulsion unit having associated therewith a yellow dye image-providing material, at least one of the silver halide emulsion units having associated there with a photographic coupler of the invention. Each silver halide emulsion unit can be composed of one or more layers and the various units and layers can be arranged in different locations with respect to one another.

The couplers of this invention can be incorporated in or associated with one or more layers or units of the photographic element. For example, a layer or unit affected by PUG can be controlled by incorporating in appropriate locations in the element a scavenger layer which will confine the action of PUG to the desired layer or unit. At least one of the layers of the photographic element can be, for example, a mordant layer or a barrier layer.

The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. The emulsions can be negative-working or direct-positive emulsions. They can form, latent images predominantly on the surface of the silver halide grains or predominantly on the interior of the silver halide grains. They can be chemically and spectrally sensitized. The emulsions typically will be gelatin emulsions although other hydrophilic colloids are useful. Tabular grain light sensitive silver halides are particularly useful such as described in *Research Disclosure*, January 1983, Item No. 22534, and U.S. Pat. No. 4,434,226.

The support can be any support used with photographic elements. Typical supports include cellulose nitrate film, cellulose acetate film, polyvinylacetal film, polyethylene terephthalate film, polycarbonate film and related films or resinous materials as well as glass, paper, metal and the like. Typically, a flexible support is employed, such as a polymeric film or paper support. Paper supports can be acetylated or coated with baryta and/or an α-olefin polymer, particularly a polymer of an α-olefin containing 2 to 10 carbon atoms such as polyethylene, polypropylene, ethylene-butene copolymers and the like.

Depending upon the nature of the particular PUG, the couplers can be incorporated in a photographic element for different purposes and in different locations.

When the PUG released from the coupler is a development inhibitor, the coupler can be employed in a photographic element like couplers which release development inhibitors have been used in the photographic art. Couplers of this invention which release a development inhibitor can be contained in, or in association with, one or more of the silver halide emulsion units in a color photographic element. If the silver halide emulsion unit is composed of more than one layer, one or more of such layers can contain the coupler of this invention. The layers can contain other photographic couplers conventionally used in the art. The coupling reaction using couplers of this invention can form dyes of the same color as the color forming coupler(s) in the layer or unit, it can form a dye of a different color, or it can result in a colorless or neutral reaction product. The range of operation between layers of the development inhibitor released from the coupler of this invention can be controlled by the use of scavenger layers, such as a layer of fine grain silver halide emulsion. Scavenger layers can be in various locations in an element containing couplers of this invention. They can be located between layers, between the layers and the support, or over all of the layers.

Photographic couplers as described which release bleach inhibitors or bleach accelerators can be employed in the ways described in the photographic art to inhibit the bleaching of silver or accelerated bleaching in areas of a photographic element.

Photographic couplers as described which release a dye or dye precursor can be used in processes where the dye is allowed to diffuse to anintegral or separate receiving layer of to form a desired image. Alternatively, the dye can be retained in the location where it is released to augment the density of the dye formed from the coupler from which it is released or to modify or correct the hue of that dye or another dye. In another embodiment, the dye can be completely removed from the element and the dye which was not released from the coupler can be retained in the element as a color correcting mask.

Couplers as described can be employed to release another coupler and the PUG. If the released coupler is a dye-forming coupler it can react with oxidized developing agent in the same or an adjacent layer to form a dye of the same or a different color or hue as that obtained from the primary coupler. If the released coupler is a competing coupler it can react with oxidized color developing agent in the same or an adjacent layer to reduce dye density.

Photographic couplers as described in which the PUG is a developing agent can be used to release a developing agent which will compete with the color forming developing agent, and thus reduce dye density. Alternatively, the couplers can provide, in an imagewise manner, a developing agent which because of such considerations as activity would not desirably be introduced into the element in a uniform fashion.

In the following discussion of suitable materials for use in the emulsions and elements of this invention, reference will be made to *Research Disclosure*, December 1978, Item 17643, published by Industrial Opportunities Ltd., Homewell Havant, Hampshire, P09 1EF, U.K., the disclosures of which are incorporated herein by reference. This publication will be identified hereafter by the term "Research Disclosure".

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclo. Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents useful in the invention are p-phenylene diamines. Especially preferred are 4-amino-N,N-diethylaniline hydrochloride; 4-amino-3-methyl-N,N-diethylaniline hydrochloride; 4-amino-3-methyl-N-ethyl-N-β-(methanesulfonamido)ethylaniline sulfate hydrate; 4-amino-3-methyl-N-ethyl-N-β-hydroxyethylaniline sulfate; 4-amino-3-β-(methanesulfonamido)-ethyl-N,N-diethlaniline hydrochloride; and 4-amino-N-ethyl-N-(2-methoxyethyl)-m-toluidine di-p-toluenesulfonic acid.

The described photographic materials and processes can be used with photographic silver halide emulsions and addenda known to be useful in the photographic art, as described in, for example, *Research Disclosure*, December 1989, Item No. 308,119, the disclosures of which are incorporated herein by reference With negative working silver halide the processing step described above gives a negative image. To obtain a positive (or reversal) image, this step can be preceded by development with a non-chromogenic developing agent to develop exposed silver halide, but not form a dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

Compounds as described can be prepared by reactions and methods known in the organic compound synthesis art. Typically, the couplers, as described, are prepared by first attaching the linking group to the coupling position of the coupler moiety without the PUG present. Then the product is reacted with an appropriate derivative of the PUG to form the coupler.

The following examples further illustrate the invention:

Photographic elements were prepared by coating the following layers on a cellulose ester film support (amounts of each component are indicated in mg/m$^2$)

| | |
|---|---|
| Emulsion layer 1: | 'Gelatin - 2420; red sensitized silver bromoiodide (as Ag) - 1615; yellow image coupler dispersed in dibutyl phthalate (RECEIVER LAYER) |
| Interlayer: | Gelatin - 860; didodecylhydroqyinone - 113 |
| Emulsion layer 2: | Gelatin - 2690; green sensitized silver bromoiodide (as Ag) - 1615; magenta image coupler dispersed in tritolyl phosphate; DIR compound in Table 1 dispersed in N,N-diethyl-dodecanamide and coated at levels of 5, 10, 15, and 20 μm/ft$^2$. (CAUSER LAYER) |
| Protective Overcoat | Gelatin - 5380; bisvinylsulfonylemthyl ether at 2% total gelatin. |

Structures of the image couplers are as follows:

MAGENTA IMAGE COUPLER:

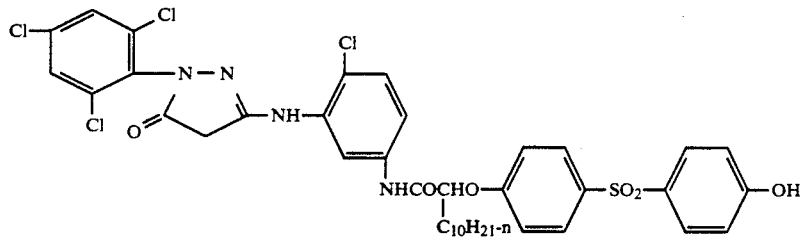

YELLOW IMAGE COUPLER:

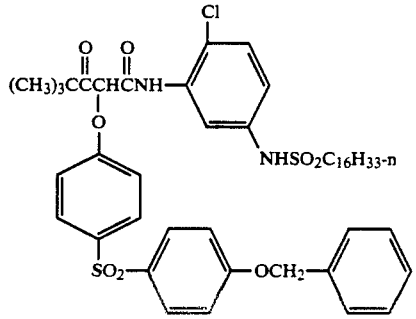

Strips of each element were exposed to green light through a graduated density step tablet, or through a 35% modulation fringe chart for sharpness measurements, and then developed 3.25 minutes at 38° C. in the following developer, stopped, washed, bleached, fixed, washed and dried.

| Color Developer: | |
|---|---|
| Distilled Water | 800 mL |
| Soldium Metabisulfite | 2.78 g |
| Sodium Sulfite, anhydrous | 0.38 g |
| CD-4 (color developer)* | 4.52 g |
| Potassium Carbonate, anhyd. | 34.3 g |
| Potassium Bicarbonate | 2.32 g |
| Sodium Bromide | 1.31 g |
| Potassium Iodoide | 1.20 mg |
| Hydroxylamine Sulfate (HAS) | 2.41 g |
| Diethylenetriaminepentacetic acid, pentasodium salt (40% Soln.) | 8.43 g |
| Distilled Water | to 1 L |
| Adjust pH to 10.0. | |

*CD-4 is 4-amino-3-methyl-N-ethyl-N-beta-hydroxy-ethylaniline sulfate.

Processed images were read with green light to determine the contrast and AMT acutance. The values resulting are reported in following Table I for a laydown of 10 μmoles of compound/sq. ft. AMT calculations employed the following formula in which the cascaded area under the system modulation curve is shown in equation (21.104) on page 629 of the "Theory of the Photographic Process", 4th Edition, 1977, edited by T. H. James: AMT=100+66Log[cascaded area/2.6696M] wherein the magnification factor M is 3.8 for the 35 mm system AMT. The use of CMT acutance is described by R. G. Gendron in "An Improved Objective Method of Rating Picture Sharpness: CMT acutance: in the Journal of SMPTE, Vol. 82, pages 1009-12, (1973). AMT is a further modification of CMT useful for evaluation systems which include the viewing of a positive print made from a negative.

Interimage effect (the degree of color correction) was evaluated after a daylight exposure. Interimage effect, as reported in Table I, was quantified as the ratio of the gamma of the green-sensitive layer (causer) to that of the red-sensitive layer (receiver).

TABLE I

| COMPOUND | GAMMA REDUCTION[1] | GAMMA CAUSER GAMMA RECEIVER | ACUTANCE (AMT) |
|---|---|---|---|
| I-1 Comparison | 0.40 | 2.52 | 92 |
| I-2 Invention | 0.71 | 2.87 | 94 |
| I-3 Invention | 1.15 | 3.01 | 94 |

I-1

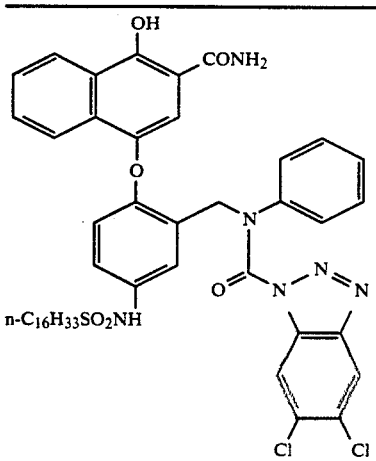

TABLE I-continued

I-2

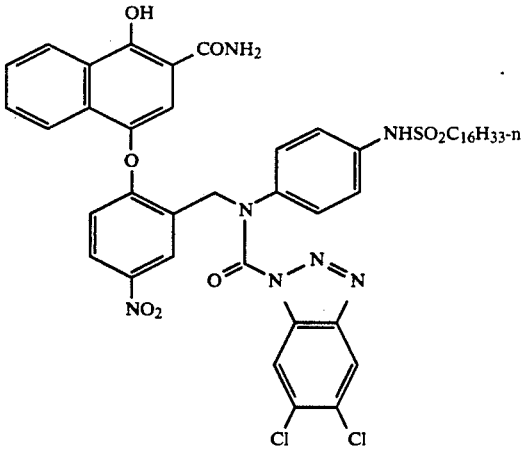

I-3

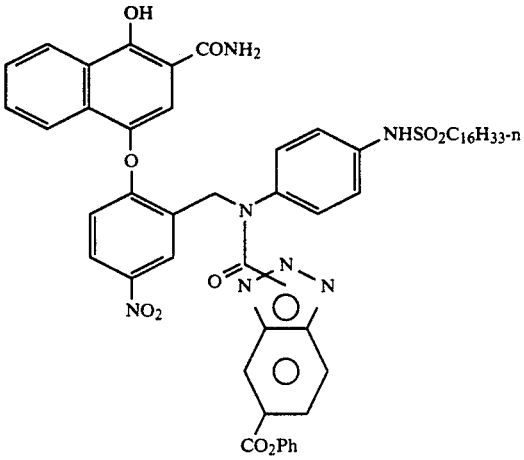

This invention has been described in detail with particular reference to preferred embodiments thereof, but it will be understood that variations and modifications can be effected within the spirit and scope of the invention.

What is claimed:

1. A photographic element comprising a support bearing at least one photographic silver halide emulsion layer, at least one image dye-forming coupler, and at least one coupler (A) represented by the formula

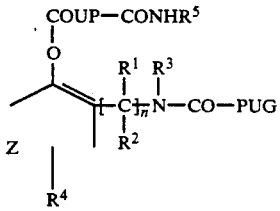

wherein n is 0 or 1

$R^1$ and $R^2$ individually are hydrogen, alkyl or aryl;

$R^3$ is photographic ballast group;

$R^4$ is hydrogen or a substituent;

$R^5$ is hydrogen, $CH_3$, $C_2H_5$, $CH_2CO_2R^6$;

$R^6$ is alkyl;

PUG is a photographically useful group;

COUP is a naphtholic coupler; and,

Z represents the atoms completing a 5 or 6 member aromatic or heterocyclic group.

2. A photographic element as in claim 1 wherein the photographically useful group is a releasable development inhibitor, developing agent, development accelerator, dye, dye-precursor, stabilizer, coupler, nucleator, fixing agent, image toner, hardener, antifoggant, or ultraviolet absorber.

3. A photographic element as in claim 1 wherein coupler (A) is represented by the formula:

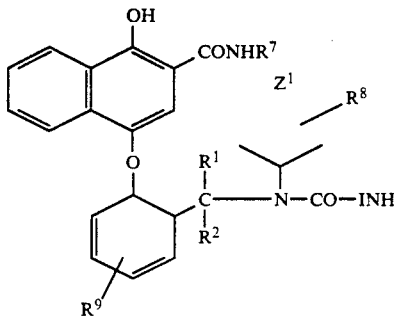

wherein $R^1$ and $R^2$ individually are hydrogen, alkyl or aryl;

$R^8$ is a photographic ballast group;

$Z^1$ represents the atoms completing an aryl group;

$R^9$ is hydrogen or a substituent;

INH is a development inhibitor group;

$R^7$ is hydrogen or methyl.

4. A photographic element as in claim 1 wherein coupler (A) is represented by the formula:

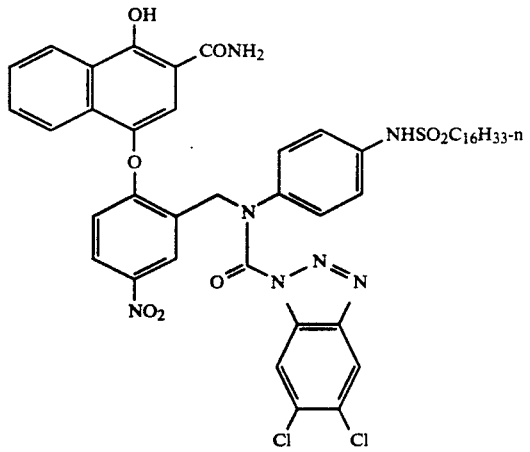

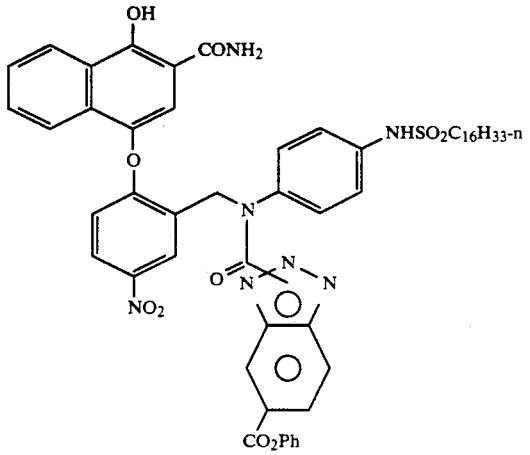

5. A process of forming a photographic image which comprises developing an exposed photographic silver halide emulsion layer with a color developing agent in the presence of a coupler (A) as defined in claim 1.

6. A process of forming a photographic image as in claim 5 wherein the coupler (A) is a coupler as defined in claim 3.

7. A process of forming a photographic image as in claim 5 wherein the coupler is as defined in claim 4.

* * * * *

UNITED STATES PATENT AND TRADEMARK OFFICE

CERTIFICATE OF CORRECTION

PATENT NO. : 5,250,398

DATED : Oct. 5, 1993

INVENTOR(S) : William J. Begley, et al

It is certified that error appears in the above-indentified patent and that said Letters Patent is hereby corrected as shown below:

Column 12, Claim 1

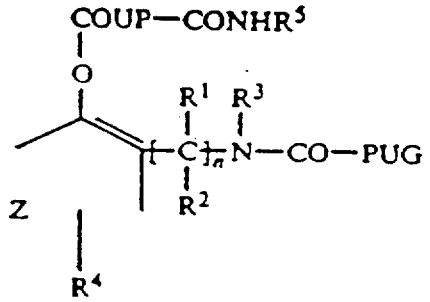

Should read--

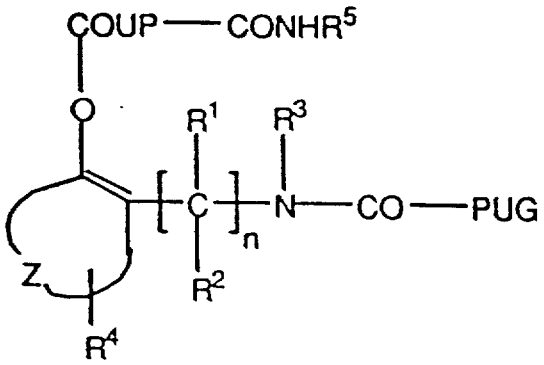

UNITED STATES PATENT AND TRADEMARK OFFICE

CERTIFICATE OF CORRECTION

PATENT NO. : 5,250,398

DATED : Oct. 5, 1993

INVENTOR(S) : William J. Begley, et al

It is certified that error appears in the above-indentified patent and that said Letters Patent is hereby corrected as shown below:

Column 13, Claim 3

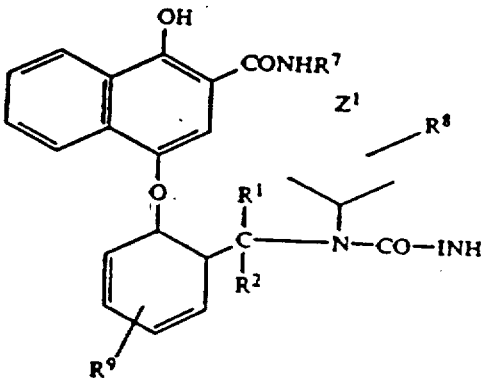

Should read--

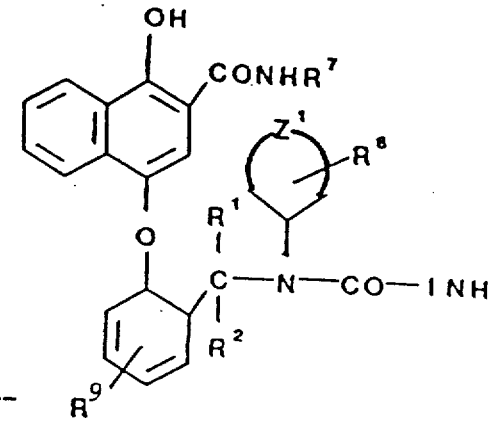

Signed and Sealed this

Third Day of May, 1994

*Attest:*

BRUCE LEHMAN

*Attesting Officer*

*Commissioner of Patents and Trademarks*